United States Patent [19]

Weigl et al.

[11] 3,944,238

[45] Mar. 16, 1976

[54] GUIDE PLATE FOR SKI BINDINGS

[75] Inventors: Erwin Weigl, Brunn am Gebirge; Josef Svoboda, Schwechat, both of Austria

[73] Assignee: Gertsch AG, Zug, Switzerland

[22] Filed: Feb. 18, 1975

[21] Appl. No.: 550,459

[30] Foreign Application Priority Data

Feb. 20, 1974 Austria ..... 1394/74

[52] U.S. Cl. ..... 280/11.35 C

[51] Int. Cl.[2] ..... A63C 9/00

[58] Field of Search 280/11.35 C, 11.35 K, 11.35 Y, 280/11.35 N, 11.35 A, 11.35 D, 11.35 E, 11.35 T, 11.35 L, 11.35 V, 11.35 R, 11.13 W

[56] References Cited

UNITED STATES PATENTS

| | | | |
|---|---|---|---|
| 3,618,965 | 11/1971 | Hecker | 280/11.35 C |
| 3,689,094 | 9/1972 | Marker et al. | 280/11.35 C |
| 3,806,144 | 4/1974 | Yans et al. | 280/11.35 C |
| 3,814,454 | 6/1974 | Beyl | 280/11.35 C |

FOREIGN PATENTS OR APPLICATIONS

| | | | |
|---|---|---|---|
| 2,004,861 | 12/1969 | France | 280/11.35 V |
| 268,118 | 1/1969 | Austria | 280/11.35 Y |

*Primary Examiner*—M. H. Wood, Jr.
*Assistant Examiner*—Milton L. Smith
*Attorney, Agent, or Firm*—Woodhams, Blanchard and Flynn

[57] ABSTRACT

A low friction device for use between a ski boot sole and the upper surface of a ski to minimize friction upon the occurrence of a relative movement between the ski boot sole and the upper surface of the ski. A low friction material insert is secured to a mounting plate which is, in turn, secured to the upper surface of the ski. The low friction material projects above the upper surface of the mounting plate to effectively engage the bottom surface of the ski boot sole. The insert may be secured to the mounting plate in a number of ways but the important characteristic is that the structure by which the mounting plate is secured to the upper surface of the ski will effect a simultaneous securement of the insert to the mounting plate.

2 Claims, 6 Drawing Figures

GUIDE PLATE FOR SKI BINDINGS

FIELD OF THE INVENTION

The invention relates to a guide plate for use between a ski boot sole and the upper ski surface to effect a low friction assist in the release of ski bindings, the guide plate being arranged within a mounting plate or the like which is secured on the upper ski surface and projects with its upper end through an opening in the mounting plate or the like.

BACKGROUND OF THE INVENTION

Guide plates of the above-described type are known in various embodiments. For example, German OS No. 2,142,678 describes a guide plate, which rests in a large-surface support member and is secured with its surface only slightly projecting over the upper side of the support member surrounding the guide plate. Through this, the danger of injury to the guide plate which, according to the information in this reference, can occur in other similar guide plates, is overcome. In this known construction, the guide plate is secured in or on the support member by gluing.

However, already in other known guide plates it has been shown to be disadvantageous to glue the guide plate to the ski because the guide plate has excellent sliding characteristics and it is thus difficult to effectively glue same with adhesive means to the ski. The mentioned reference is supposed to simplify the glued securement by having the glue only absorb vertical stresses, because otherwise the guide plate is held by the sides of a trough into which the guide plate is placed, however, the disadvantageous gluing of the guide plate could also be avoided in this solution. To screw the guide plate in the trough would bring about the same difficulties, which occur by the wear of the surface of the guide plate in other guide support secured by means of screws.

The purpose of the invention is to produce a guide plate of the above-mentioned type, in which the guide plate is held without any additional fastening exclusively by a suitable construction of the guide plate and the support member.

The aforementioned purpose is attained according to the invention by the provision of a mounting plate which serves as a support member and which receives the guide plate in an opening therein and at least the guide plate has an offset, projection, shoulder or the like, which cooperates with a correspondingly constructed holding part of the mounting plate.

The inventive construction achieves a secure holding of the guide plate in the support member so that additional methods of securement like, for example, glue or screws would not be necessary.

According to a preferred embodiment of the invention, the sliding member and the mounting plate have offsets, projections, shoulders or the like extending over the entire periphery. Through this a specially good holding of the guide plate in the support member is achieved.

According to a different thought of the invention, the material of the actual sliding surface is provided only in the upper area of the guide plate and the guide plate itself is mounted on a support, whereby the offsets, projections, shoulders or the like are provided on the support. This embodiment has the advantage that the material having relatively valuable, good low friction sliding characteristics must be used only in a small amount.

In a further development of the thought of the invention, the actual guide plate is secured on the support by engaging pins, bolts or the like or also recesses, like holes, grooves or riffles. According to a further characteristic of the invention, a conventional adhesive material can be provided between the guide plate and the support. All of these embodiments serve to improve a holding of the guide plate to the support member.

According to a still further thought of the invention, the opening in the mounting plate has dimensions which are constant in elevational direction and the offsets, projections, shoulders or the like are constructed in the part of the guide plate extending below the upper surface of the mounting plate. This construction has the advantage that projecting shoulders or the like do not need to be provided in the mounting plate, which simplifies the manufacture thereof. Since the guide plate itself is secured on the ski by screws, the adjusting of the guide plate to the dimensions of the opening in the mounting plate is less critical. Of course the high material costs of the guide plate must be considered, in this embodiment. The entire construction can thereby be dimensioned so that the lower part of the guide plate and the mounting plate correspond together to the height of a common mounting plate.

BRIEF DESCRIPTION OF THE DRAWINGS

Further details of the invention will be described more in detail in connection with the drawings, which illustrate several embodiments of the invention.

In the drawings.

DETAILED DESCRIPTION

Figure 1:
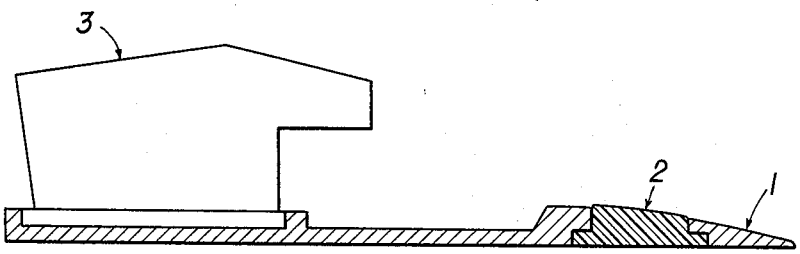
FIG. 1 is a side view of a first embodiment of the inventive guide plate, partially cut in connection with a mounting plate and a ski binding.
Figure 2:
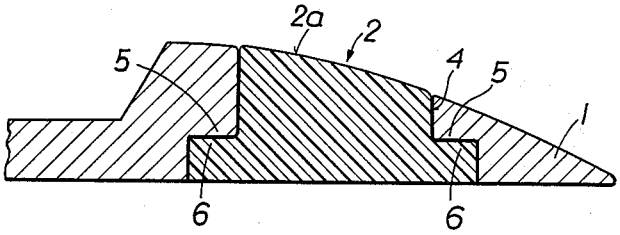
FIG. 2 illustrates in an enlarged scale the guide plate according to FIG. 1, FIGS. 3 and 5 illustrate two further embodiments.

As can be recognized from FIGS. 1 and 2, a guide plate 2 made of a material having particularly good low friction sliding characteristics, preferably of a tetrafluoroethylene material, is arranged in a mounting plate 1. To be complete, FIG. 1 also shows the arrangement of a conventional ski binding component 3 on the mounting plate 1.

The mounting plate 1 has, in the area in which the guide plate 2 is arranged, an opening 4 therein. The opening 4 has a counterbore on the bottom side to define shoulders 5. The guide plate 2 has outwardly extending shoulders 6 thereon which engage the shoulders 5 on the mounting plate 1. The guide plate 2 projects with its upper surface 2*a* above the mounting plate 1 and the upper end of the recess 4.

With this construction, it is possible to place the guide plate 2 into the mounting plate 1 and thereafter, the mounting plate secured to a ski so that the guide plate 2 is securely held without any further measures by said mounting plate. Both the manufacture of the guide plate 2 and also its installation into the mounting plate 1 can be carried out easily. It is thereby of particular advantage that the guide plate 2 is held without any additional fastening means in and by the mounting plate 1 which is secured to the ski.

Figure 3:
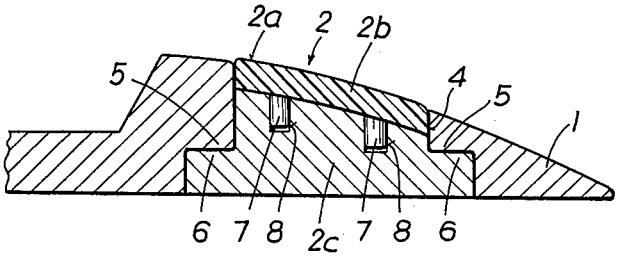

The embodiment according to FIG. 3 is constructed similarly to the one according to FIGS. 1 and 2, with the only difference being that the guide plate 2 consists of two parts. The lower part 2*c* is made of a different material than the upper part 2*b* which forms the actual sliding surface. For a secure holding of the upper part 2*b* to the lower part 2*c*, pins, bolts 7 or the like are provided which engage holes, grooves or riffles 8 or the like. It is easily conceivable to reverse the fastening, namely to mount the pins, bolts 7 or the like on the lower part 2*c* and to have them engage the holes, grooves or riffles 8 in the upper part 2*b*. It is also possible to secure the two parts in a conventional manner by gluing and/or by screws. This latter embodiment has the advantage that only the upper part 2*b* and not the entire guide plate 2 must consist of a high-grade material having special low friction sliding characteristics, because the lower part does not need to meet such objectives.

A different type of securement of the upper part 2*b* on the lower part 2*c* can take place in that the two parts 2*b* and 2*c* enclose an intermediate layer (not illustrated). To use an intermeditate layer, of actually known material, has the advantage that the guide plate can have particularly good low friction sliding characteristics in relation to the intermediate layer, which intermediate layer is secured on the lower part.

Figure 4:
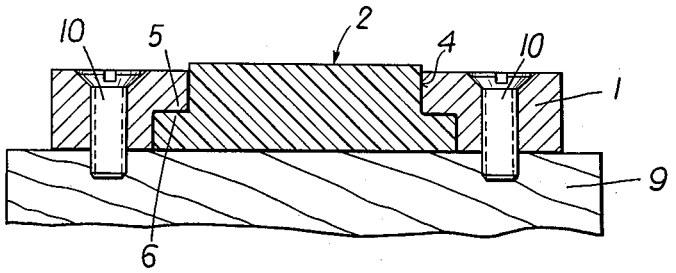
FIGS. 4 and 4*a* are associated views to FIG. 2.

FIG. 4 illustrates a mounting plate 1 secured on a ski 9 by means of screws 10, where the inlaid guide plate 2 is also held on the ski 9 by the mounting plate 1.

Figure 4A:
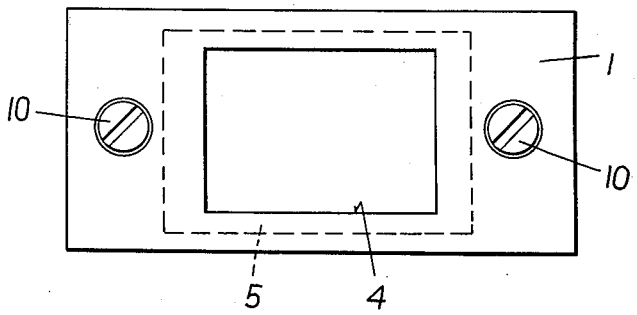

FIG. 4*a* is a top view of FIGS. 2 and 4 without the presence of the guide plate 2, in order to more clearly show the opening 4.

Figure 5:
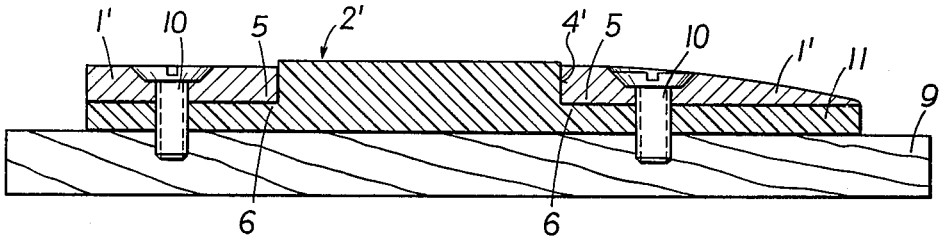

FIG. 5 illustrates a further embodiment, in which a mounting plate 1′ has an opening 4′ therein having a constant dimension along the entire height of the mounting plate. A guide plate 2′ extends upwardly through the opening 4′. The guide plate 2′ has forwardly and backwardly extending projections which act as additional supports 11 arranged between the ski 9 and mounting plate 1′. The supports 11 serve thereby at the same time as a shoulder holding the guide plate 2′ in the opening 4′. The guide plate 2′ is secured on the ski 9 by means of the screws 10 guided through holes in the additional supports 11, which screws 10 secure the mounting plate 1′ to the ski 9. The heads of the screws 10 are moved in the manner from the sliding plane into areas where wear on the guide plate 2′ has no disadvantages.

The invention is not limited to the illustrated exemplary embodiment. Further possibilities of construction exist which lie within the scope of the invention. For example, the upper part of the guide plate can be constructed similar to that shown in FIGS. 1 and 2 but the lower part may consist only of an insert, which prevents a falling out of the guide plate. In this case, high-grade material can be saved, without creating additional problems of fastening, as for example in the embodiment according to FIG. 3. A different type of fastening comprises a guide plate which is essentially made only of one upper part having a hole therein, the upper part being held to the mounting plate by means of a longitudinal bolt which is received in a hole through the mounting plate and the longitudinal bolt or rod is received in an opening at the other end of the mounting plate. The longitudinal bolt can, for the purpose of a secure holding, have also a screw thread at its end which cooperates with a nut part provided in the opening. The longitudinal bolt or screw bolt may, if desired, also be inclined. Depending on the need, several longitudinal bolts or screw bolts can be arranged side-by-side.

Screw pins can, in a further development of the invention, be arranged in a slotted hole for engagement and disengagement with the opening provided in the mounting plate. The screw pins have inwardly extending screw bolts with opposite threads which can be adjusted by a central operating member. For this purpose the central part of the slotted hole is accessible from below. The type of securement itself should be familiar to the man skilled in the art.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a guide plate for use between a ski boot sole and an upper surface of a ski adjacent a ski binding component, said guide plate being fixed with respect to said ski and arranged within a support plate secured on said upper surface of said ski and having an upper surface projecting above said support plate, said support plate having an opening receiving said guide plate therein, the improvement comprising wherein said guide plate comprises a support member having an upper surface recessed below the upper surface of said support plate and a low friction guide surface mounted only on the upper surface of the support member, said guide surface projecting above the upper surface of said support plate, the lower portion of said support member engaging said upper surface of said ski, said support member having offset means thereon greater in dimension than said opening through said support plate and overlappingly cooperating with a correspondingly constructed holding part on said support plate to hold said support member and thereby said guide plate on said ski.

2. An improved guide plate according to claim 1, wherein said low friction surface means is secured on said support member by a vertically oriented pin and recess connection therebetween.

* * * * *